US009205451B2

(12) United States Patent
Zahr

(10) Patent No.: US 9,205,451 B2
(45) Date of Patent: Dec. 8, 2015

(54) MATERIAL DISPENSING SYSTEM

(76) Inventor: Wadeeh Zahr, Osafiya (IL)

( * ) Notice: Subject to any disclaimer, the term of this patent is extended or adjusted under 35 U.S.C. 154(b) by 0 days.

(21) Appl. No.: 13/642,634

(22) PCT Filed: Apr. 26, 2011

(86) PCT No.: PCT/IL2011/000331

§ 371 (c)(1),
(2), (4) Date: Oct. 22, 2012

(87) PCT Pub. No.: WO2011/132193

PCT Pub. Date: Oct. 27, 2011

(65) Prior Publication Data

US 2013/0037567 A1 Feb. 14, 2013

(30) Foreign Application Priority Data

Apr. 22, 2010 (WO) ..... PCT/IL2010/000323

(51) Int. Cl.
*B67D 1/00* (2006.01)
*B05C 17/01* (2006.01)

(52) U.S. Cl.
CPC ..... *B05C 17/0106* (2013.01)

(58) Field of Classification Search
USPC ..... 222/134–137, 325–328, 336, 339, 340, 222/386, 80, 160, 391
See application file for complete search history.

(56) References Cited

U.S. PATENT DOCUMENTS

| | | | | |
|---|---|---|---|---|
| 5,503,307 | A | 4/1996 | Wilson et al. | |
| 6,382,466 | B1 * | 5/2002 | Schneider et al. | 222/137 |
| 8,544,683 | B2 * | 10/2013 | Springhorn et al. | 222/1 |
| 2002/0108971 | A1 | 8/2002 | Lefond | |
| 2008/0006654 | A1 * | 1/2008 | Lampe et al. | 222/80 |

FOREIGN PATENT DOCUMENTS

WO 2007144434 A1 12/2007

* cited by examiner

*Primary Examiner* — Paul R Durand
*Assistant Examiner* — Randall Gruby
(74) *Attorney, Agent, or Firm* — William H. Dippert; Eckert Seamans Cherin & Mellott, LLC

(57) ABSTRACT

A dispensing device (300) is provided that comprises housing (360) having a grooved base (320) and configured to accommodate a container (10); cutting-pushing element (40) that comprises cutting-pushing base (48) slidably held by groove (322), push plate (42), at least one blade (44) comprising a sharp edge (45), and at least one tooth (47). A force transmitting element (370) is further coupled to the cutting and pushing element base. Movement of the cutting-pushing element forwards, toward the nozzle (11), by employment of the force transmitting element, inserts the push-plate into the container, so as to push the viscous material (16) out of the nozzle, and cuts lengthwise the container. Moreover, movement of the cutting-pushing element backwards, away from the nozzle, by release of the force transmitting element, allows at least one tooth to engage and pull the container backwards into the housing.

18 Claims, 15 Drawing Sheets

MATERIAL DISPENSING SYSTEM

CROSS-REFERENCE TO RELATED APPLICATIONS

This application is a U.S. National Phase filing of PCT Patent Application No. PCT/IL2011/000331, filed Apr. 26, 2011, which is based upon and claims the benefit of the priority of PCT Patent Application No. PCT/IL2010/000323, filed Apr. 22, 2010, both of which are incorporated herein by reference.

FIELD OF THE INVENTION

The present invention relates to construction utensils. In particular, the invention relates to hand-held material dispensing devices.

BACKGROUND

Viscous substances such as silicon glue are often used in construction for sealing crevasses or adhering surfaces to each other. These substances are typically applied through utensils such as a caulk gun, which enable pushing the substance out of the container in which it is stored in order to apply it onto a surface or to fill in crevasses.

Conventional hand-held material dispensing devices rely on the action of a piston to push paste-like materials out of a tube's nozzle. The movement of the piston may be induced by employing mechanical means such as a trigger or a spring; Typically, a rod is used to push forward the moveable cap of standard containers. The rod needs to be as long as the longest commercially available container, and positioned behind the container's cap.

Using a rod makes conventional caulk guns long and heavy. Use of such devices is cumbersome, particularly in tight places that can be reached only with compact instruments.

Several improvements have been made to the operation mechanism of such material dispensing devices. U.S. Pat. No. 5,887,765 titled "Caulk Gun" to Dripless Inc. adds a biasing mechanism to relieve the back pressure inside the caulk tube while maintaining the position of the piston during a given trigger stroke even after the trigger has been released. This mechanism, however, does not contribute to the reduction of size or weight of such a caulk gun.

Similarly, U.S. Pat. No. 4,386,717 titled "Dispenser Having Hose-Like Expandable Member" to Freidrich Koob describes a device for measured discharge of viscous substance which appears to be relatively compact. This device, however, requires that the container incorporates an expandable hose-like member configured to couple with a propellant or expanding medium which forces the substance through an outlet, and is not compatible with standard containers.

One way to reduce the overall length of caulk guns with containers fitted thereto is to cut the containers' walls behind the piston as the piston advances along the interior of the container. The cutting may be accomplished by urging a blade against the container walls during the employment of the caulk gun.

For example, JP63185475 to WAKAI SANGYO is directed to a caulk gun with a cutting blade, in the rear of a pressing plate, both of which advance from the back to the front along a cartridge. The gun has a mechanism for holding a cartridge vessel, and a feeding mechanism is provided for moving the pressing plate, the vessel cutting blade advancing in cooperation with the pressing plate. Contents in the vessel are discharged by the advancement of the pressing plate.

U.S. Pat. No. 6,640,998 to ALBION ENGINEERING COMPANY describes a caulking gun having a hand-held trigger operating clamp with a blade mounted on the clamp whereby the clamp and a bar cooperate to cause a cartridge containing caulk to move axially against a fixed plunger mounted on the clamp and the blade servers the cartridge containing caulk to permit the plunger to be advanced the length of the cartridge containing caulk.

U.S. Pat. No. 3,606,085 to Ian Butler Spilman depicts a dispensing gun with a handle mounting a support at its upper end, a thrust member mounted on the support and rising thereabove for engagement and cooperation with a piston member for expressing the contents of a substance container, guide means in the support, a carriage moveable through the guide means and normally arranged to extend forwardly of the handle, a container holder mounted on the forward part of the carriage and arranged so that an outlet nozzle end part of the container may be held and supported between the forward container holder and the thrust member, a moveable trigger associated with the handle, a carriage moving means associated with the carriage and operable by the trigger to move the carriage in the guide means a desired distance, the construction providing that squeezing the trigger into or towards the handle causes the carriage moving means to move the carriage with the container a prescribed distance relative to the thrust member associated with the piston member for the container in delivering and dispensing a desired amount of substance from the container.

US20080006654 to John Lampe and Douglas Oudekerk describes a device for dispensing flowable materials such as caulk, including for example a cartridge and a dispenser with: a drive mechanism for advancing a pusher forward, the drive mechanism having at least one fulcrum positioned forward of the pusher during operation of the dispenser; a cutter that cuts a slit in a wall of the cartridge for purposes of dispensing a flowable material, and a winch for driving the dispensing of a flowable material from the cartridge.

WO2007144434 to Seamus and Tracey Devlin is directed to a sealant gun or like device that includes a hollow cylindrical barrel containing sealant or other viscous material, a plunger located in the barrel, and a drive mechanism for effecting relative axial movement between the plunger and the barrel to eject the material from a nozzle at the front of the barrel. The drive mechanism includes means for engaging the barrel progressively along its length to draw the barrel rearwardly relative to the drive mechanism and plunger. In particular, engaging means described therein are for progressively separating at least one longitudinal strip of the barrel to provide a slot through which a part of the drive mechanism can project and the drive mechanism includes a cutting means for separating the longitudinal strip.

The drive mechanism is described to be for example include a support, a grip ring loosely surrounding the barrel at the front of the support, means resiliently biasing the grip ring and support apart in the axial direction of the barrel, and an actuator for repeatedly tilting the grip ring to grip the barrel, moving the grip ring rearwardly against the resilient bias while the barrel is gripped, and releasing the grip ring to allow it to be moved forwardly along the barrel by the resilient bias, thereby to draw the barrel incrementally in a rearward direction.

Means for engaging with the barrel is described to preferably include an endcap for locating at the front of the barrel, and a cable connecting the endcap to the drive mechanism.

Cutting means is described to preferably include at least one cutting wheel, the cutting wheel acting on the surface of the barrel to cut the surface of the barrel to be received, and preferably, the cutting means include at least one internal cutting wheel and at least one external cutting wheel, the at least one internal cutting wheel mounted within the housing acting on the internal surface of the barrel, the at least one external cutting wheel mounted within the housing acting on the external surface of the barrel.

Although the device described in WO2007144434 may be considerably shorter than the length of the uncut barrel, the force employed to engage and pull the strip, together with additional forces employed to perform the additional operations occurring during the strip pulling (such as extrusion of viscous material), require the device to be unwieldy massive.

None of the references discussed above require nor recognize the advantage of having teeth on a cutting-pushing element to dispensing devices.

The need remains, therefore, for compact, simple, lightweight, hand-held viscous material dispensing devices that can be used in small confined locations and may be coupled with various sizes of viscous material containers. Embodiments described hereinbelow address this need.

SUMMARY OF THE INVENTION

According to one aspect, a device for dispensing viscous material out of a container is provided, the container comprising a nozzle and a movable cap, the viscous material being disposed therebetween, the device comprising:

- a housing comprising a grooved base and configured to accommodate the container;
- a cutting-pushing element comprising:
  - a cutting-pushing base slidably held by the groove;
  - a push plate;
  - at least one blade comprising a sharp edge, and
  - at least one tooth,
  - said blades, push plate and teeth mounted on said base, and said teeth disposed between the push plate and the blade edge, facing away from the push plate,
- a force transmitting element coupled to said cutting and pushing element base,
- wherein when said container is accommodated in said housing:
- movement of said cutting-pushing element forwards, toward the nozzle, by employment of the force transmitting element, inserts the push-plate into said container, pushing said viscous material out of said nozzle, and cuts lengthwise the container, and
- movement of said cutting-pushing element backwards, away from the nozzle, by release of the force transmitting element, allows at least one tooth to engage and pull said container backwards into said housing.

Said housing may be configured to accommodate tubular containers of various lengths and diameters.

Said housing preferably comprises a support configured to allow essentially immobilizing said container within said housing during the movement of the cutting-pushing element forwards.

In some embodiments, said force transmitting element comprises a hand operated trigger coupled to the cutting-pushing element and to the housing, and first urging means, whereby squeezing the trigger forces movement of said element forward, and release of said trigger allows first means to force movement of the container backward.

Some embodiments are configured to be operable with one hand.

Said viscous material may be selected from a group comprising of: gels, glues, sealants, paints, baking doughs, syrups, plasticine, modeling clay composite posts, adhesive composites, curing adhesives, impression compounds and pastes.

Preferably the device is substantially shorter than the container.

The blade edge and teeth are preferably metal, or the blade edge, teeth and first spring metal, and the housing and trigger are preferably thermoplastic.

Some embodiments further comprise a stopper coupled to the housing, configured to clasp the container within the housing during at least some of the time the trigger is squeezed.

The stopper may comprise an aperture with an edge, the edge having a profile, the stopper connected to the housing, yet free to move backwards and forwards, the stopper shape and dimensions, together with a profile of the aperture edge of the stopper, allowing binding the container by the stopper being urged backwards by second urging means in the groove, second means being coupled to the housing base, such that the container is not appreciably moved forwards when the trigger is squeezed.

The housing may further comprise a neck at a front part of the housing, the stopper held within the neck, and a release ring, wherein an internal part of the neck comprises a thread for screwing the release ring onto the housing, the stopper comprising a plurality of teeth which are flexible, such that the stopper teeth are urgable by the release ring, whereby in order to secure the container in the device, the container is inserted into the housing, and then the release ring is screwed outwards from the housing, such that the stopper element straightens until the stopper teeth entrench in the container, thus preventing movement of the container forwards during employment of the force transmitting element, yet allowing the container to move backwards during release of the element, extraction of the container from the device involving screwing the release ring into the housing.

The stopper preferably has blunt teeth when used with particular containers, for example containers comprising thin metallic walls are not punctured by the stopper teeth.

Some embodiments further comprise a slitted flexible friction element fitting inside a slitted flexible stopper in a front part of the housing, configured to allow when a container is mounted on the housing, and the stopper then brought towards the nozzle of the container, to hold the container in place during the employment of the force transmitting element.

The friction element may comprise a strip of elastomeric material coated with sandpaper coating.

Some embodiments with a stopper further comprise second urging means placed behind the stopper and acting against the stopper to push it forward, toward the nozzle.

BRIEF DESCRIPTION OF THE FIGURES

For a better understanding of the invention and to show how it may be carried into effect, reference will now be made, purely by way of example, to the accompanying drawings.

With specific reference now to the drawing in detail, it is stressed that the particulars shown are by way of example and for purposes of illustrative discussion of embodiments only, and are presented in the cause of providing what is believed to be the most useful and readily understood description of the principles and conceptual aspects of the invention. In this regard, no attempt is made to show structural details of the invention in more detail than is necessary for a fundamental understanding of the invention; the description taken with the drawing making apparent to those skilled in the art how the several forms of the invention may be embodied in practice.

In the accompanying drawings:

FIG. 1 illustrates a prior art tubular container for viscous materials such as silicone glue;

FIG. 2A illustrates a perspective view of an embodiment of a toothed cutting-pushing element employed within embodiments of compact material dispensing devices;

FIG. 2B illustrates a perspective view of a blade in a cutting-pushing element;

FIG. 2C shows a side view of a cutting-pushing element coupled with a trigger;

FIG. 3A illustrates a perspective view of an embodiment of a compact material dispensing device comprising a toothed cutting-pushing element;

FIG. 3B illustrates a perspective view of the embodiment shown in FIG. 3A ready for operation with a tubular container such as shown in FIG. 1;

FIG. 3C shows a view of the embodiment shown in FIG. 3A ready for operation with a tubular container, from another perspective;

FIG. 4A illustrates a side view of a very short embodiment of a compact material dispensing device with a cutting-pushing element, and requiring the element to be equipped with teeth;

FIG. 4B shows a rear view of the very short manual embodiment shown in FIG. 4A;

FIG. 4C shows a front view of the very short manual embodiment shown in FIG. 4A showing a stopper element contained therein;

FIG. 4D illustrates an embodiment of the stopper element employed within the embodiment shown in FIGS. 4A-C; and FIG. 5A is a perspective view of another embodiment that requires the cutting-pushing element to be toothed to effectively operate;

Figure 5A:
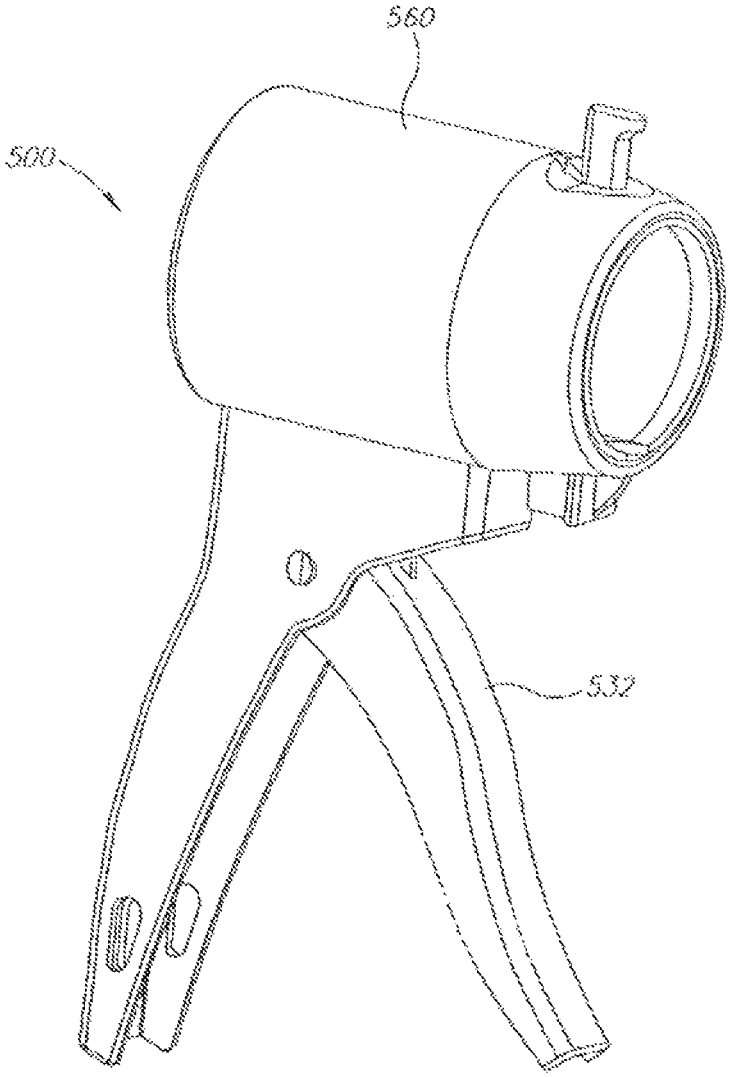
Figure 5B:
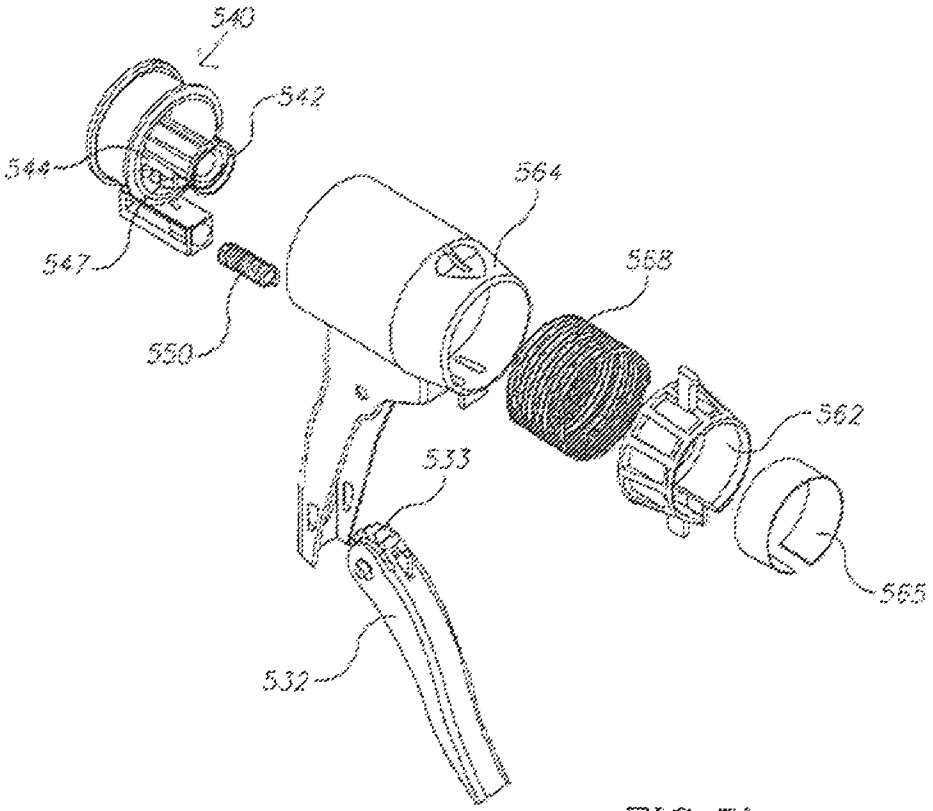
Figure 5C:
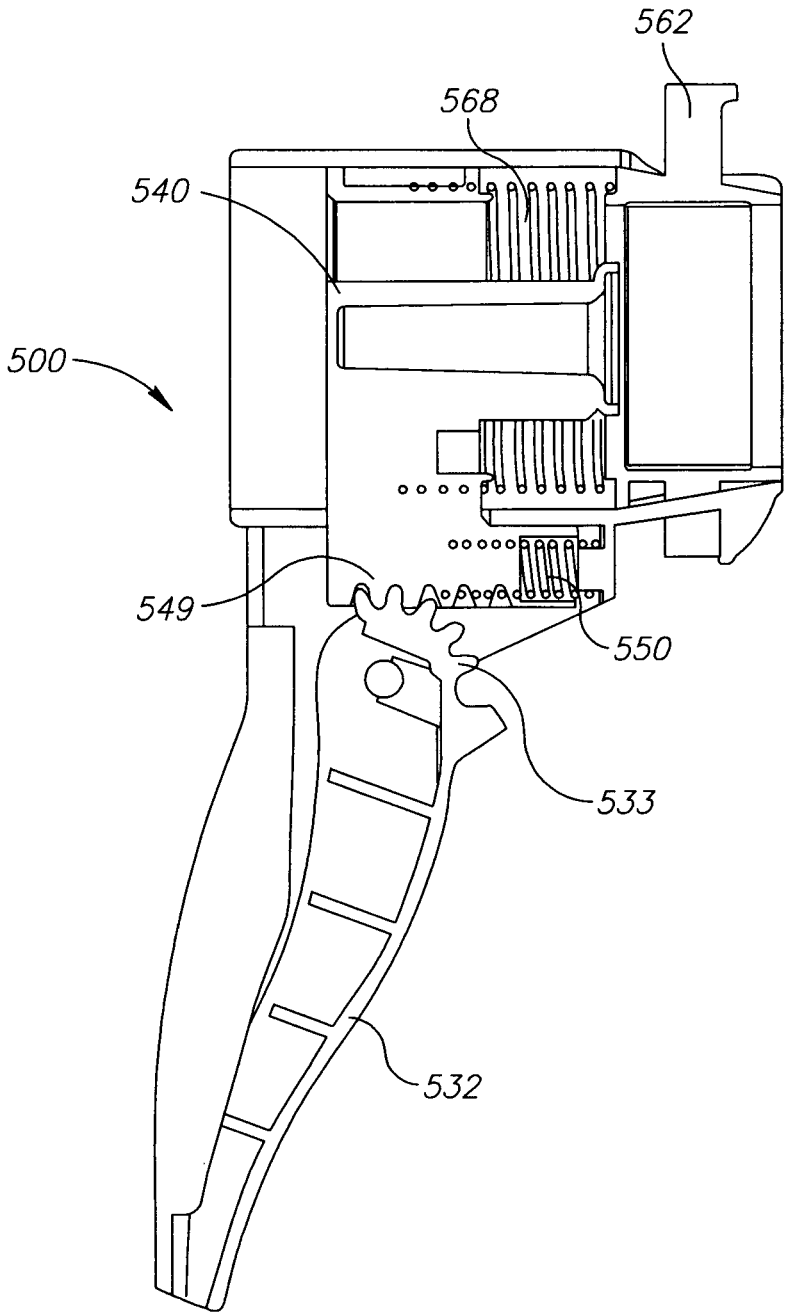
Figure 6:
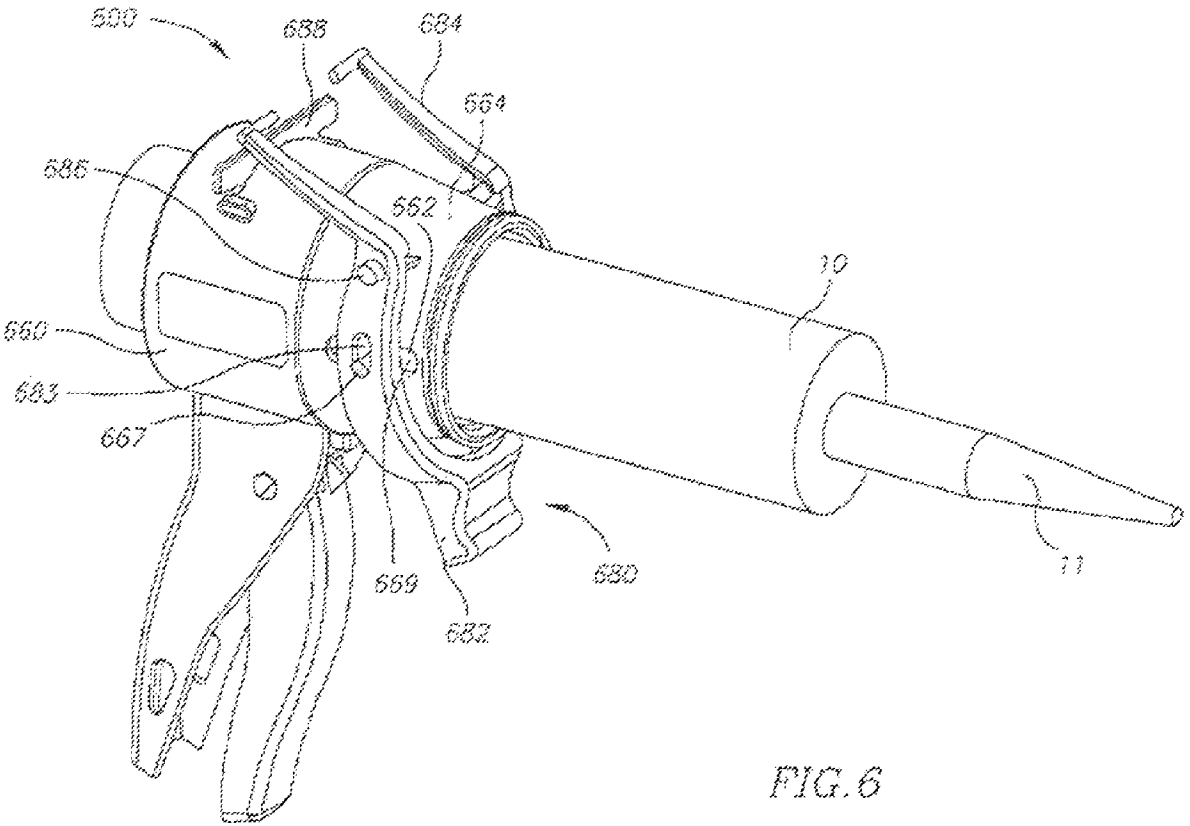

FIG. 5B shows the embodiment in FIG. 5A in exploded view;

FIG. 5C shows a sectional side-view of the embodiment of FIG. 5A;

FIG. 6 illustrates in perspective view yet another embodiment with a toothed cutting-pushing element.

DETAILED DESCRIPTION OF THE INVENTION AND DRAWINGS

Container

Figure 1:
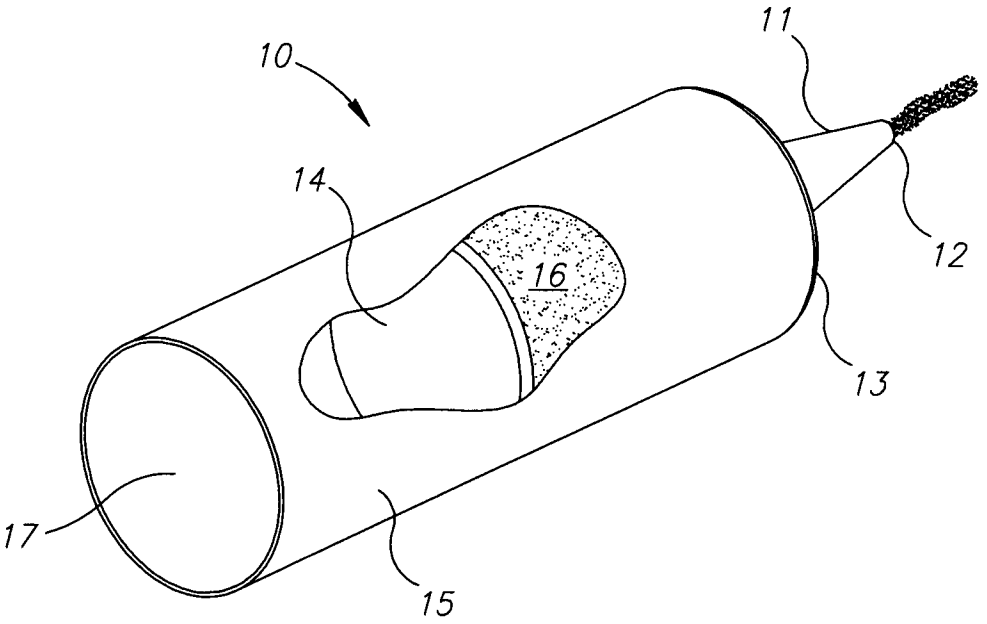

FIG. 1 illustrates a standard tubular container 10 which can be mounted onto paste dispensing devices such as glue guns, dispensing guns for sealants or the like. Standard containers typically have a nozzle 11 with an aperture 12 at the front 13 from which the material 16 is dispensed and a rear side 15 having a moveable cap 14. When the container is full, the moveable cap 14 is located at the back end 17 of the container 10. Force exerted upon the container's movable cap 14 causes the cap to move forward within the container 10, compressing and squeezing the material 16 towards the nozzle 11. Material 16 stored within the container 10 is pushed out of the container through the nozzle aperture 12. The rear side of the container emptied of material 16 will be referred to as the empty tail 15 of the container 10. The empty tail 15 can grow in length as more material is dispensed out of the container 10, and can become shorter if cut off.

Cutting-Pushing Element

A cutting-pushing element may comprise a push plate and a blade where the blade is positioned behind the push plate and is configured to follow the push-plate as the cutting-pushing element is moved. Means for coupling the push plate and the blade together may vary.

Figure 2A:
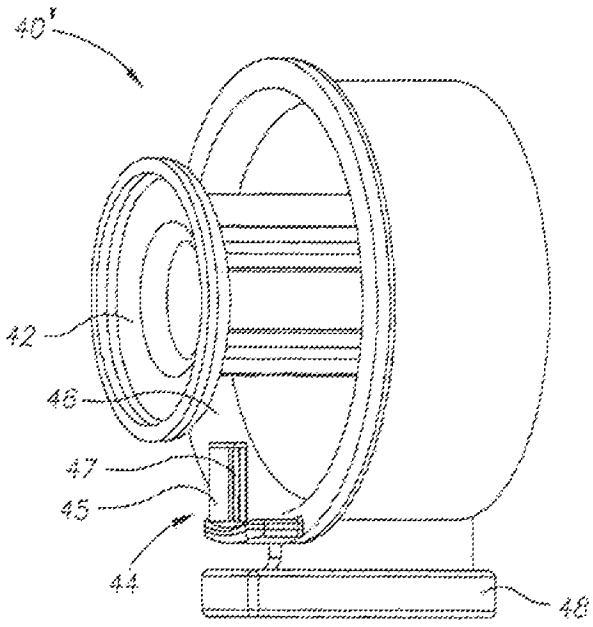
Figure 2B:
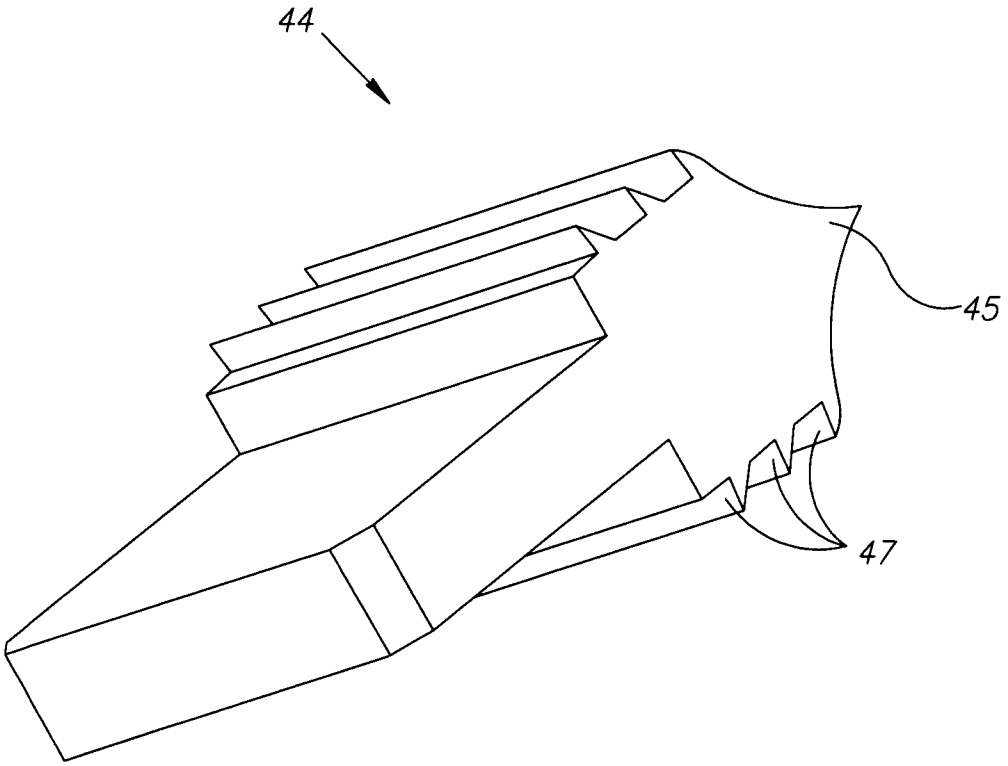

Reference is now made to FIG. 2A illustrating a perspective view of an embodiment of a toothed cutting-pushing element 40' comprising a push plate 42, a blade 44 positioned behind the push plate, and a connector element 46 assembled on a cutting-pushing base 48. The push plate 42 may be of various shapes and sizes, enabling it to be inserted into containers whose cross sections are of different shapes. Push plate 42 is coupled to the blade 44, through a connector element 46. The blade is positioned to follow the push plate. As better shown in FIG. 2B, blade 44 has a sharp edge 45 for cutting container walls and teeth 47 behind the sharp edge 45, and facing away from the push plate (not shown).

In various embodiments of a cutting-pushing element, there may be more than one blade.

Figure 2C:
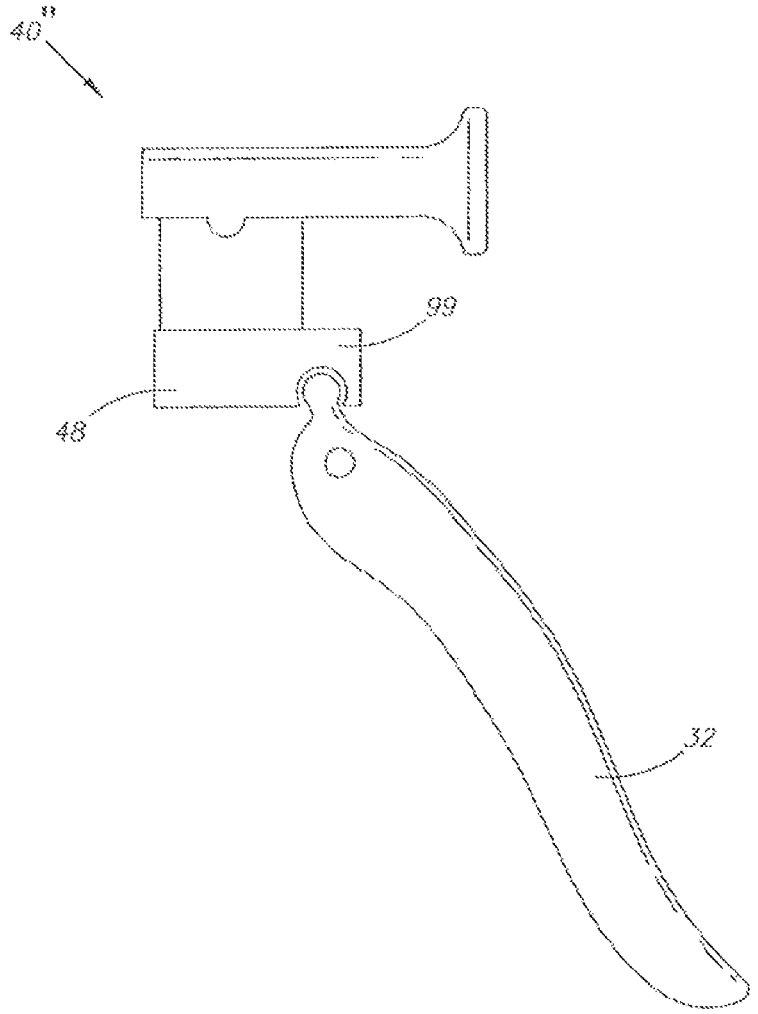

FIG. 2C illustrates a side view of a toothed cutting-pushing element 40' coupled with a trigger 32.

Material Dispensing Devices

Figure 3A:
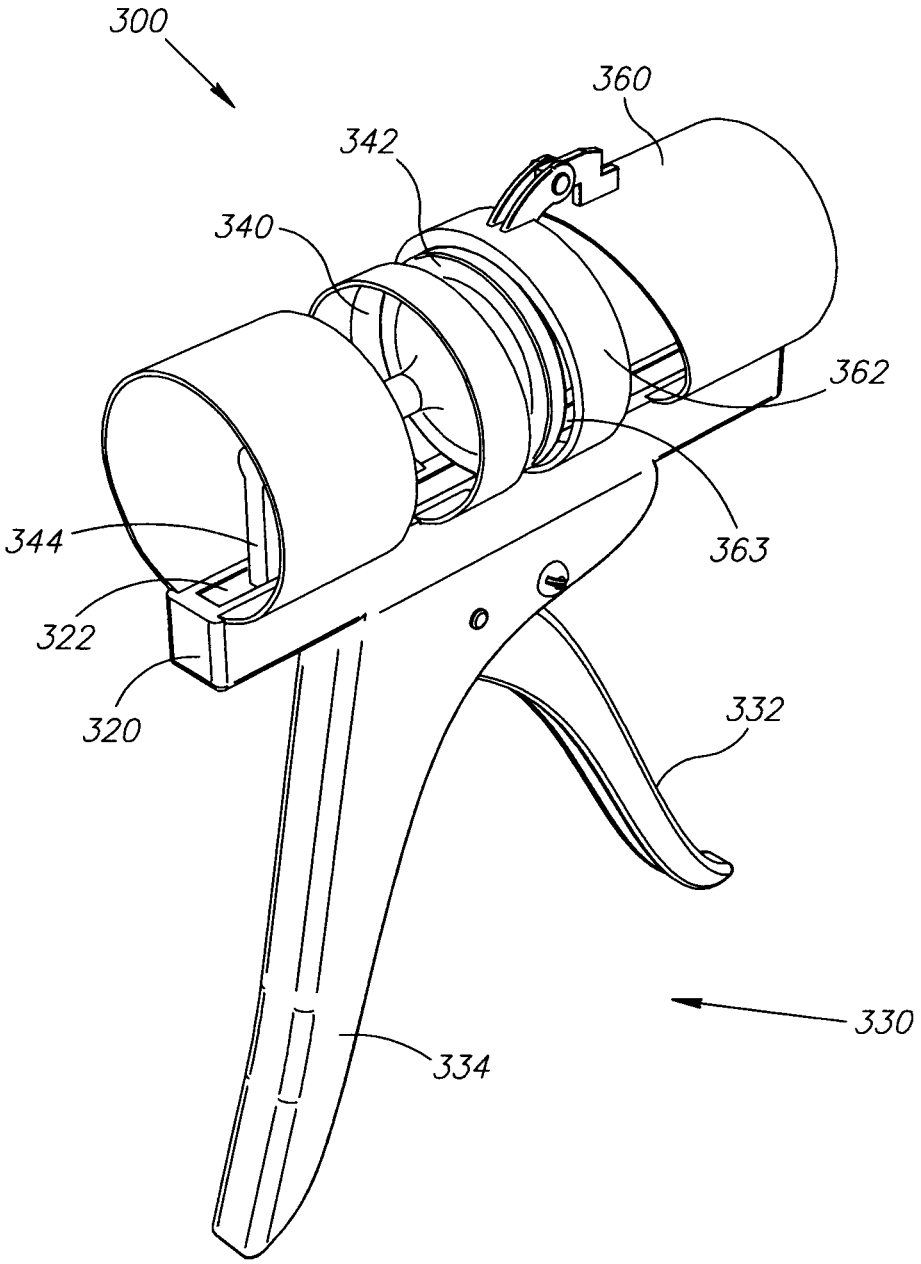
Figure 3B:
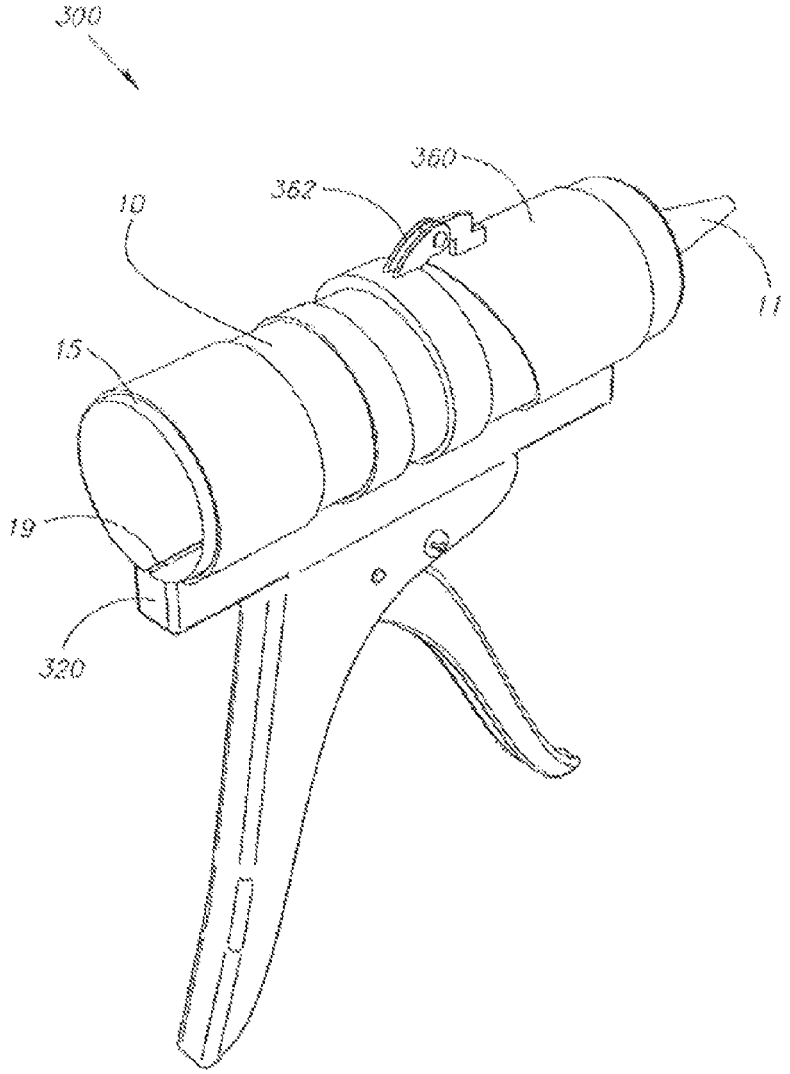
Figure 3C:
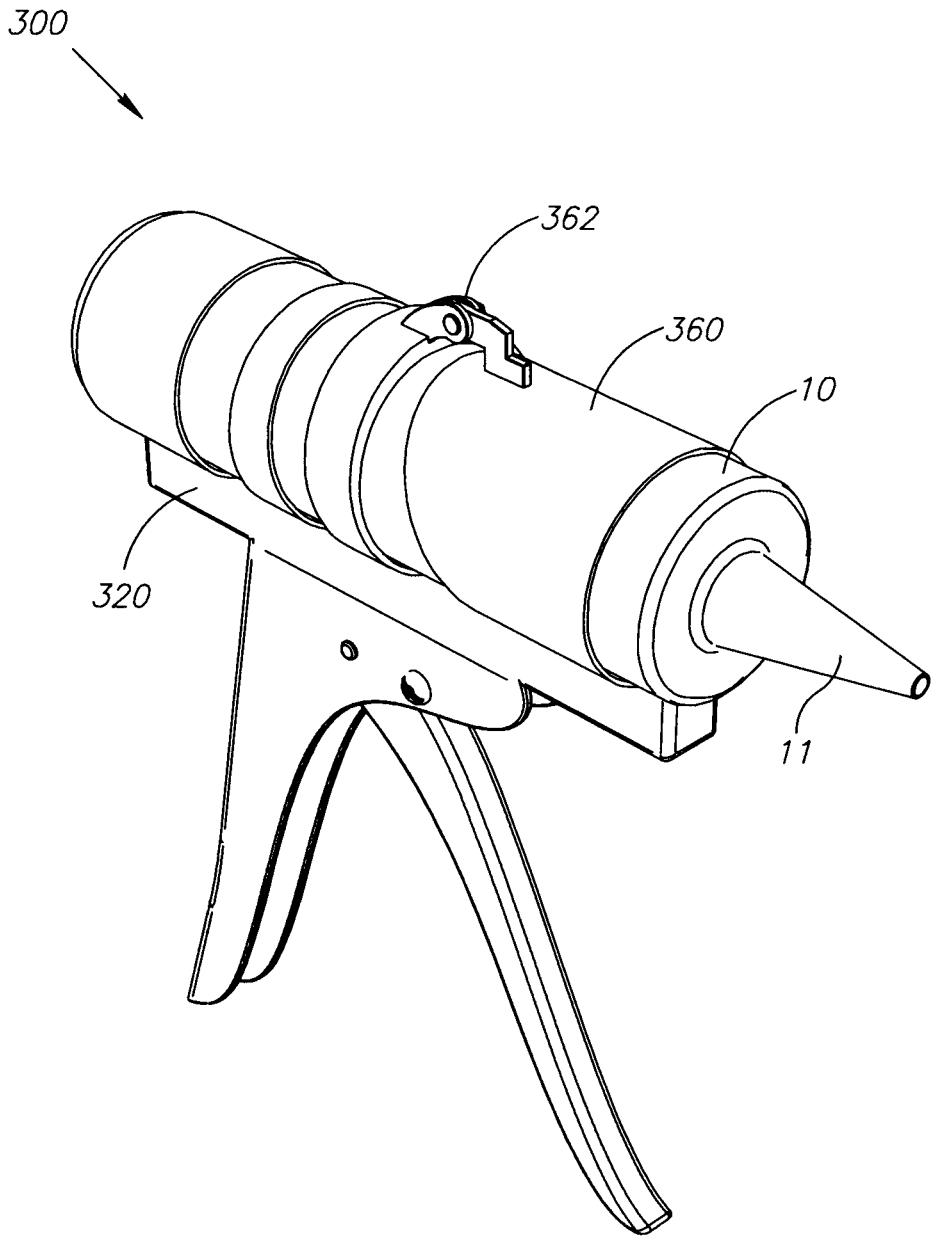

Reference is now made to FIG. 3A showing a view of a compact viscous material dispensing device 300, in accordance with an embodiment and FIGS. 3B, 3C showing a rear view and a front view respectively of the embodiment ready for operation, loaded with a standard container 10. As shown, the device 300 comprises a housing 360, a housing base 320 comprising a groove 322, a force transmitting mechanism 330 with a retracting trigger 332 and a handle 334, and a toothed cutting-pushing element 340.

The cutting-pushing element configured for the device 300 also includes a cutting-pushing base, not shown in FIG. 3A but shown in FIG. 2A as base 48, that can move along the groove 322. The retracting trigger 332 is configured to push cutting-pushing element 340, causing the push plate base to move forward along the groove 322 of the housing base 320. A spring (not shown) in the force transmitting mechanism 330 is compressed when the trigger 332 is squeezed, the squeezing extent determining the extent to which the cutting-pushing element 340 with a push plate 342 can travel within the groove 322 of the housing base 320.

As the cutting-pushing element 340 moves forward, the push plate 342 pushes the moveable cap of the container towards the container nozzle 11, and the blade 344 cuts a slit 19 in the empty tail 15 of the container 10 where material has been squeezed out.

The slit 19 created in the container 10 enables further forward insertion of the push plate 342 into the container 10, thus extruding material out of the container 10.

Stopper 362 is configured to clasp the tube and secure it within the container housing 360 during at least some of the time the trigger 332 is squeezed: for example, the bottom part of the stopper 362 may not be bound to the housing base 320 but rather be connected to the housing 360 such that it is free to move backwards and forwards. The stopper shape and dimensions, together with a lower aperture edge 363 profile, allow to bind the container 10 by the stopper 362 being urged backwards, for example by a spring (not shown) in the groove 332, coupled to the housing base 320 in front of the stopper 362 and to the front (nozzle) side of stopper 362, such that the container is not appreciably moved forwards during the trigger squeezing. However, when the trigger is released, the teeth (not shown) engage the container 10 and the spring coupled to the trigger 332 urges the container 10 backwards, the container not being bound by the stopper 362 from moving backwards.

Note that release of the container 10 from the device 300 may be performed by simply forcing the stopper 362 forwards (toward the nozzle 11).

With this design, a rod typically used in prior art dispensing devices for pushing the moveable cap of the container forward is unnecessary, and the dispensing device can be made lighter and more compact. The housing for holding the container does not include a nozzle support and may be shorter than the original length of the container 10. Upon initial use, the container 10 is placed such that the moveable cap is placed proximal to the push plate 342 of the cutting-pushing element 340 and the front of the container may stick out of the container's housing without further support.

Note that containers of various diameters may be used by the device 300.

Figure 4A:
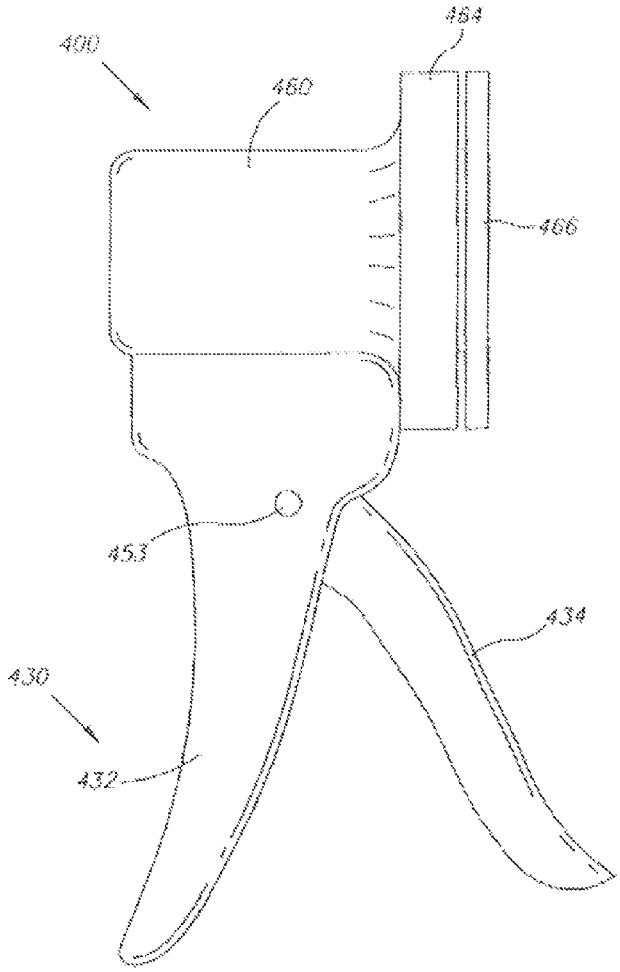

Reference is hereby made to FIG. 4A showing a side view of a very short manual embodiment of a viscous material dispensing device 400. The embodiment includes a toothed cutting-pushing element (FIG. 4B), housing 460, a neck 464, a release ring 466 and a force transmitting mechanism 430. The housing 460 is configured to accommodate tubular viscous material containers of various sizes, as will be explained below. The internal part of the neck 464 comprises a thread for screwing the release ring 466 onto the housing 460. The force transmitting mechanism 430 may be used to manually apply force on the cutting-pushing element 440 within the housing 460. The mechanism 430 may be coupled to the cutting-pushing element 440 similar to the coupling shown in FIG. 2C. In this embodiment, the mechanism 430 comprises a static part 432 and a trigger or moving part 434 coupled together via a coupling pin 453. A powerful v-shaped spring (not shown) has one arm in the static part 432 and one arm in the moving part 434, and a coil held by the pin 453. As in the formerly described embodiment, the spring in the mechanism serves to urge the container backwards when the moving 434 is released.

Figure 4B:
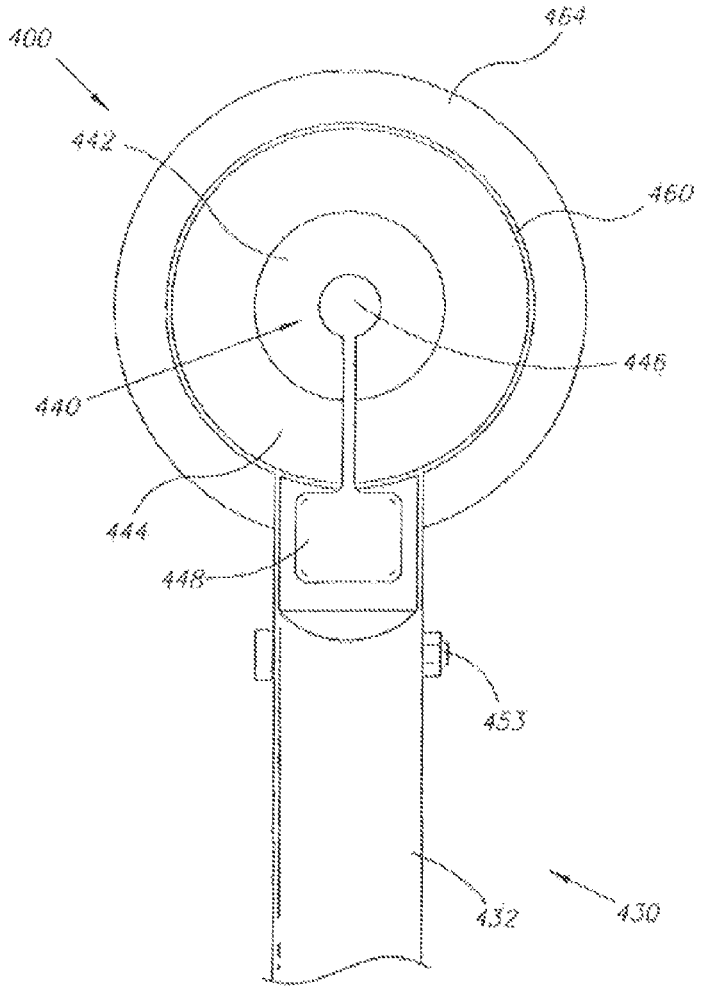

Reference is hereby made to FIG. 4B showing a rear view of the very short manual embodiment of the viscous material dispensing device 400. The rear view shows the static part 432 and the coupling pin 453 of the mechanism 430. The rear view further shows the back of the cutting-pushing element 440 assembled within the housing 460, comprising a push plate 442, a blade 444, a connector element 446 assembled on a cutting-pushing base 448 and at least one tooth (not shown) pointed towards the rear.

Figure 4C:
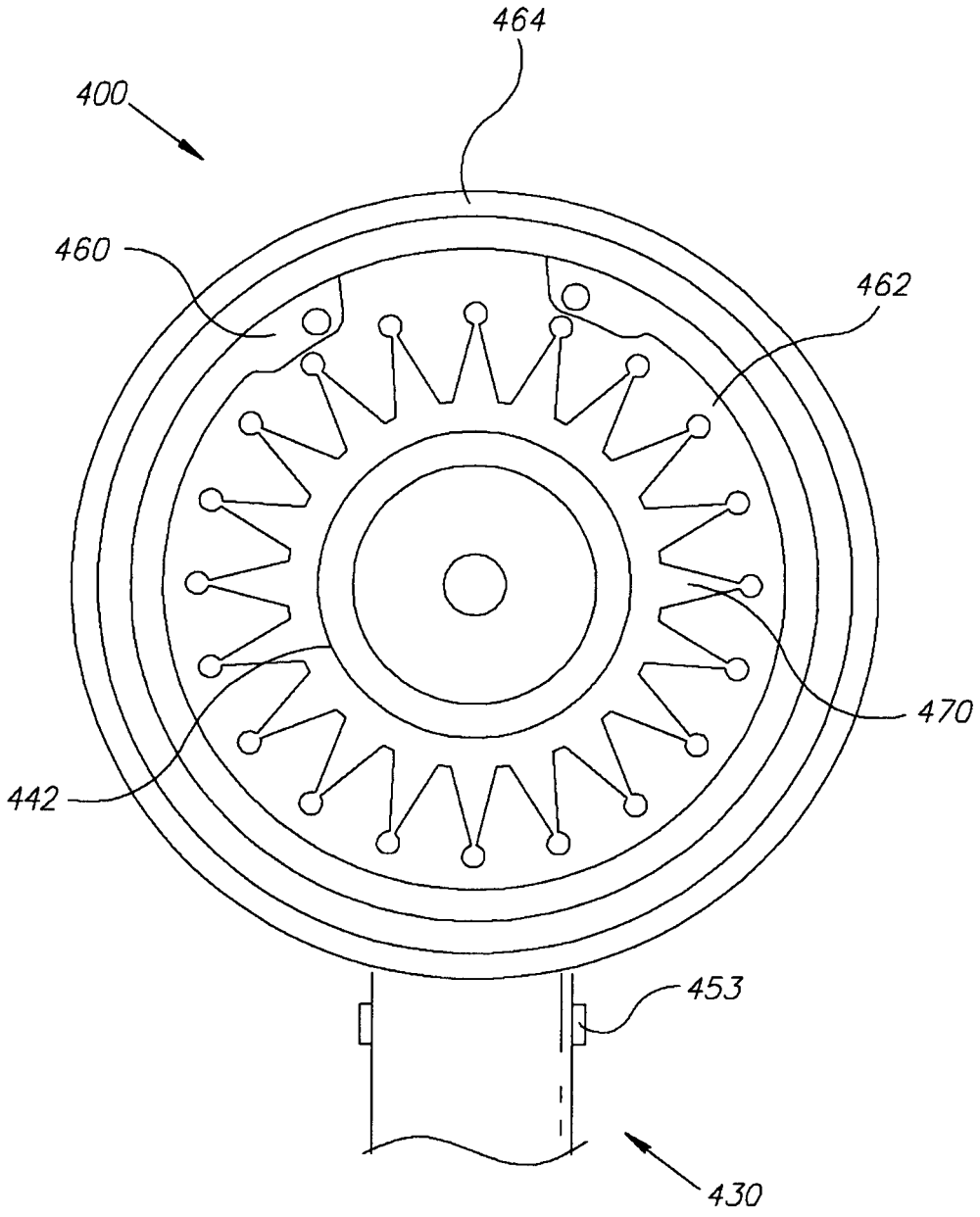

Reference is now made to FIG. 4C showing a front view of the very short manual embodiment of a viscous material dispensing device 400. The front view shows the front side of the push plate 442 (black) and an embodiment of a stopper element 462 connected to the container housing 460, 470 is a space between the push plate 442 and the stopper element 462, where a tubular container (such as 10 in FIG. 1) can be inserted into the device 400.

Figure 4D:
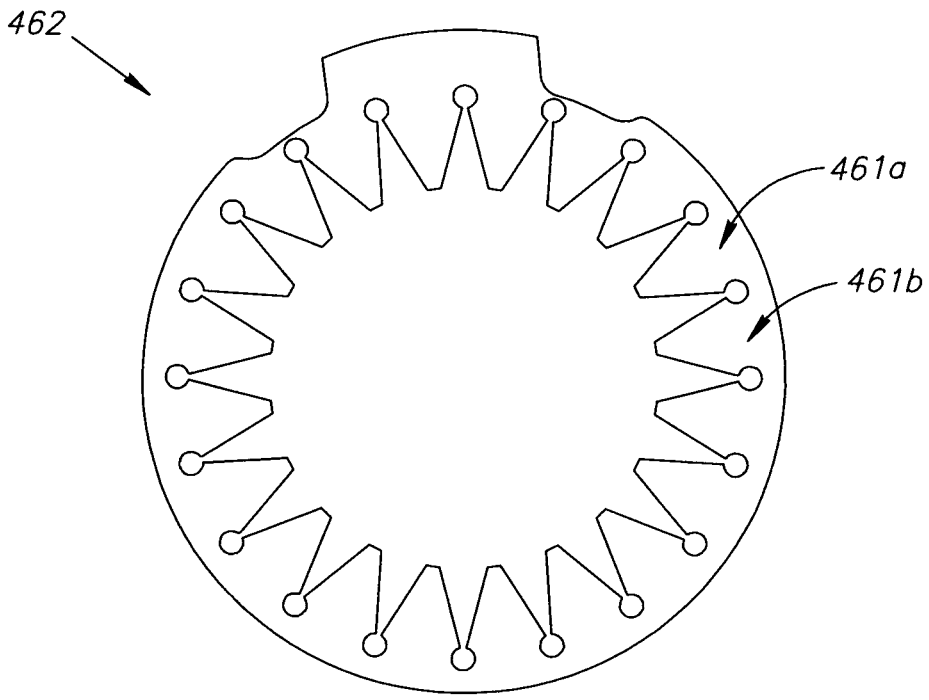

FIG. 4D illustrates the embodiment of the stopper element 462 shown in FIG. 4C. This embodiment comprises a plurality of teeth (teeth 461*a* and 461*b* are marked). In this embodiment, the teeth are flexible, such that they can bend more or less towards the inside in the container housing (460 in FIGS. 4A, 4B and 4C). However, in general, the teeth are urged by the release ring inwards. In order to secure a tubular container 10 in the device 400, the container 10 is inserted into the container housing 460 from the front of the device 400, and then the release ring 466 is screwed outwards from the housing 460, such that the stopper element 462 straightens outward until the teeth entrench in the container 10. Attempting to pull the container out from within the housing 460 will result in the teeth being even more firmly entrenched in the container, thus not enabling the extraction of the container, as well as preventing movement of the container forwards during employment of the force transmitting mechanism 430. However, the teeth due to their facing backwards (away from the nozzle and towards the interior of the housing 460), allow the container to move backwards during release of the mechanism 430.

The extraction of a tubular container (10 in FIG. 1) from this embodiment involves screwing in the release ring (466 in FIG. 4A) into the housing 460. The release ring 466 pushes the teeth of the stopper element 462 towards the inside of the housing 460, thus creating sufficient space (470 in FIG. 4C) to allow the container to be extracted.

The device is both very powerful and very lightweight and compact. Its length may be as little as 8 cm, and its weight may be as little as 150 grams. Use of strong plastics such as polycarbonate for most of the parts (aside from teeth and blade) allows making a strong and light device.

The stopper 462 may easily be replaced with a stopper with more blunt or smaller teeth 461*a, b*, to better suit some containers. For example, containers comprising thin metallic walls are typically more easily accidentally punctured than thermoplastic containers and may require blunt teeth 461*a, b*.

Yet another embodiment is shown in FIGS. 5*a*-5*d*.

A flexible friction element 565 fits inside a flexible stopper 562. The front part 564 of the housing 560 slopes in an angle similar to the angle of the friction element 565, which is placed in the front of the housing 560.

A big spring 568 is placed behind the stopper 562 and acts against the stopper 562 to push it forward, toward the nozzle (when a container is properly mounted on the housing 560).

A container (not shown) is mounted in the housing 560, with the nozzle of the container extending out of the housing 560, and is held firmly in place by the stopper 562—the big spring 568 urges the stopper 562 forwards, thus closing the stopper 562 (the stopper 562 and the friction element 565 have each a slit at the bottom) until the stopper 562 can no longer move forwards (the inner diameter of friction element 565 assuming the outer diameter of the container).

The friction element 565 is for example a strip of rubber coated with coarse sandpaper coating, to prevent the container from moving during operation of the device 500.

The trigger 532 has cogs 533 that engage matching cogs 549 on the cutting-pushing element 540.

When the trigger 532 is squeezed, the cutting-pushing element moves as a result forwards in the housing 560. The element 540 has a push plate 542 at the front that can push the cap of the glue container forward. The element 540 also has a blade 544 behind the push plate 542, that cuts lengthwise the container's wall, in the direction of the nozzle, while the element is pushed forward. The container is held in place during the pushing by the stopper 562 and friction element 565.

When the handle is released, a little spring 550 coupled to the element 540 and the housing 560 pulls the element 540 back. The blade 544 on the inner body has sharp teeth 547 facing backwards—these teeth 547 engage the walls of the container, helping to pull the container back with the element 540.

The part of the container extending out of the front of the housing 560 becomes shorter during operation, by the container being pulled back after each release of the trigger 532.

Note, however, that the device can work without the big spring 568 (device not shown), albeit less effectively. When a container is inserted into the housing, until its tail is flush with the blade edge, and then the trigger is first pressed, the stopper may move forward and assume a position along the front part, such that it both holds the container firmly in place during the squeezing of the trigger, and is essentially held in place during the release of the trigger.

FIG. 6 shows a similar embodiment 600 with a container 10 mounted thereon. Inside the embodiment 600 there is a stopper 662 very similar to the stopper 462 of the embodiment 400 described above. The difference is essentially the position of the pins.

The stopper has at least one pin 667 extending out from it, that is inserted each into a slot 669 in the front part 664 of the housing 660, the slot 669 allowing movement of the stopper back and forth along the slot 669, but preventing excessive backward movement of the stopper, beyond the front part 664, such that the stopper is not held by the housing 660.

The embodiment 600 further has a handle 680 similar in role to the release ring 466 in embodiment 400, except that in this embodiment 600 the clasping of the container walls is automatic.

The handle 680 has a finger tab 682, a hole 683 accommodating the stopper pin 667, another hole (not visible) accommodating a pin 686 extending out of the housing front 664, and arms 684 capable of clasping a ridge 688 on the housing 660. Pushing the finger tab 682 away from the nozzle 11 allows the cartridge 10 to be released from the grasp of the stopper.

It should be noted that a viscous material dispensing device can be used in a variety of fields, not limited to construction. For example, a small embodiment of the viscous material dispensing device may be used in dental procedures when material needs to be dispensed into a patient's mouth. The mouth is a confined space, and reduction of the size of the utensil used to apply viscous material into a patient's mouth may be very useful.

In embodiments used in medical and dental procedures, the size of the container may be very small. Embodiments of the compact viscous material dispensing device for medical and dental use may be used to replace other viscous material application utensils requiring a push piston such as syringes. In the medical and dental embodiments, the hand-operated trigger may be small and designed to be operable with a finger. Optionally, the force transmission mechanism could be powered and the trigger may be operable by a push of a button.

Medical and dental applications could also be for home use, for example and without limitation dispensing teeth-bleaching material out of a teeth-bleaching material container and into a teeth mold to be applied upon a subject's teeth overnight. Other applications may be used during medical surgery or cosmetic procedures, such as insertion of silicon or Botulinum toxin A to body cavities.

Other embodiments of the compact viscous material dispensing device may be used in cooking and baking, for example for insertion of material such as melted chocolate into dessert cups.

Assembling a cutting pushing element on a viscous material dispensing device relieves the need for using a rod to push the cap of a tubular container towards the container's nozzle, enabling a compact design of the dispensing device. The reduction in the dispensing device's size assists in making it lighter in weight and easier to operate in small, confined spaces. Embodiments may be used in various fields, such as but not limited to construction, manufacturing, cooking, baking, cosmetics, dental procedures and other medical uses.

The scope of the present invention is defined by the appended claims and includes both combinations and sub combinations of the various features described hereinabove as well as variations and modifications thereof, which would occur to persons skilled in the art upon reading the foregoing description.

In the claims, the word "comprise", and variations thereof such as "comprises", "comprising" and the like indicate that the components listed are included, but not generally to the exclusion of other components.

The invention claimed is:

1. A device for dispensing viscous material out of a container, the container comprising a nozzle and a movable cap, the viscous material being disposed therebetween, the device comprising:

a housing comprising a grooved base and configured to accommodate the container;

a cutting-pushing element comprising:

a cutting-pushing base slidably held by the groove;

a push plate;

at least one blade comprising a sharp edge; and at least one tooth, said blades, push plate and teeth being mounted on said cutting-pushing base, and said teeth being disposed between the blade edge and the push plate, facing away from the push plate; and a force transmitting element coupled to said cutting and pushing element base, wherein when the container is accommodated in said housing;

movement of said cutting-pushing element forwards, toward the nozzle, by employment of the force transmitting element, inserts the push-plate into said container, pushing said viscous material out of said nozzle, and cuts lengthwise the container, and movement of said cutting-pushing element backwards, away from the nozzle, by release of the force transmitting element, allows at least one tooth to engage and pull said container backwards into said housing, and wherein said force transmitting element comprises a hand operated trigger coupled to the cutting-pushing element and to the housing, and first urging means, whereby squeezing the trigger forces movement of said element forward, and release of said trigger allows first means to force movement of the container backward.

2. The device of claim 1, wherein said housing is configured to accommodate tubular containers of various lengths and diameters.

3. The device of claim 1, wherein said housing comprises a support configured to allow essentially immobilizing said container within said housing during the movement of the cutting-pushing element forwards.

4. The device of claim 3, wherein said force transmitting element comprises a hand operated trigger coupled to die cutting-pushing element and to the housing, and first urging means, whereby squeezing the trigger forces movement of said element forward, and release of said trigger allows first means to force movement of the container backward.

5. The device of claim 1, configured to be operable with one hand.

6. The device of claim 1, wherein said viscous material is selected from the group consisting of gels, glues, sealants, paints, baking doughs, syrups, plasticine, modeling clay composite posts, adhesive composites, curing, adhesives, impression compounds, and pastes.

7. The device of claim 1, wherein the device is substantially shorter than the container.

8. The device of claim 1, wherein the blade edge and teeth are metal.

9. The device of claim 1, wherein the blade edge, teeth and first spring are metal.

10. The device of claim 1, wherein the housing and trigger are thermoplastic.

11. The device of claim 1, the device further comprising a stopper coupled to the housing, configured to clasp the container within the housing during at least some of the time the trigger is squeezed.

12. The device of claim 11, wherein the stopper comprises an aperture with an edge, the edge having a profile, the stopper connected to the housing, yet free to move backwards and forwards, the stopper shape and dimensions, together with a profile of the aperture edge of the stopper, allowing binding the container by the stopper being urged backwards by second urging means in the groove, second means being coupled to the housing base, such that the container is not appreciably moved forwards when the trigger is squeezed.

13. The device of claim 11, the housing, further comprising a neck at a front part of the housing, the stopper held within the neck, and a release ring, wherein an internal part of the neck comprises a thread for screwing the release ring onto the housing, the stopper comprising a plurality of teeth which are flexible, such that the stopper teeth are urgable by the release ring, whereby in order to secure the container in the device, the container is inserted into the housing, and then the release ring is screwed outwards from the housing, such that the stopper element straightens until the stopper teeth entrench in the container, thus preventing movement of the container forwards during employment of the force transmitting element, yet allowing the container to move backwards during release of the element, extraction of the container from the device involving screwing the release ring into the housing.

14. The device of claim 13, wherein the stopper has blunt teeth whereby containers comprising in metallic walls are not punctured by the stopper teeth.

15. The device of claim 11, further comprising a suited flexible friction element fitting inside a slitted flexible stopper in a front part of the housing, configured to allow when a container is mounted on the housing, and the stopper then brought towards the nozzle of the container, to hold the container in place during the employment of the force transmitting element.

16. The device of claim 15, wherein friction element comprises a strip of elastomeric material coated with sandpaper coating.

17. The device of claim 15, further comprising second urging means placed behind the stopper and acting against the stopper to push it forward, toward the nozzle.

18. The device of claim 1, wherein the device is configured to be operable with one hand and is substantially shorter than the container.

* * * * *